US008487731B2

(12) United States Patent
Morimoto

(10) Patent No.: US 8,487,731 B2
(45) Date of Patent: Jul. 16, 2013

(54) MAGNETIC ELEMENT, AND ANTENNA DEVICE USING THE MAGNETIC ELEMENT

(75) Inventor: Yasunori Morimoto, Tokyo (JP)

(73) Assignee: Sumida Corporation (JP)

( * ) Notice: Subject to any disclaimer, the term of this patent is extended or adjusted under 35 U.S.C. 154(b) by 283 days.

(21) Appl. No.: 12/665,756

(22) PCT Filed: Jun. 19, 2008

(86) PCT No.: PCT/JP2008/061251

§ 371 (c)(1),
(2), (4) Date: Dec. 21, 2009

(87) PCT Pub. No.: WO2008/156145

PCT Pub. Date: Dec. 24, 2008

(65) Prior Publication Data

US 2010/0188180 A1 Jul. 29, 2010

(30) Foreign Application Priority Data

Jun. 19, 2007 (JP) ..... 2007-160875

(51) Int. Cl.
*H01F 7/02* (2006.01)

(52) U.S. Cl.
USPC ..... 335/302; 335/220

(58) Field of Classification Search
USPC ..... 335/220–229, 302–306
See application file for complete search history.

(56) References Cited

U.S. PATENT DOCUMENTS

| | | | | |
|---|---|---|---|---|
| 4,490,903 | A * | 1/1985 | Agatahama | 29/622 |
| 5,880,655 | A * | 3/1999 | Dittmann et al. | 335/78 |
| 6,078,236 | A * | 6/2000 | Mohler et al. | 335/272 |
| 6,927,739 | B2 * | 8/2005 | Nomura et al. | 343/788 |
| 7,135,946 | B2 * | 11/2006 | Hoffmann | 335/78 |
| 2005/0104698 | A1 * | 5/2005 | Kakehashi et al. | 335/220 |
| 2007/0132535 | A1 * | 6/2007 | Kakehashi et al. | 336/182 |
| 2007/0210975 | A1 * | 9/2007 | Someya et al. | 343/788 |
| 2008/0179445 | A1 * | 7/2008 | Shoji et al. | 242/570 |
| 2011/0291783 | A1 * | 12/2011 | Yamada et al. | 336/192 |

FOREIGN PATENT DOCUMENTS

| | | | |
|---|---|---|---|
| DE | 19812836 | A1 | 9/1999 |
| JP | H58-95009 | U | 12/1983 |

(Continued)

OTHER PUBLICATIONS

International Search Report for International Application No. PCT/JP2008/061251 mailed Sep. 16, 2008 with English translation.

(Continued)

*Primary Examiner* — Bernard Rojas
(74) *Attorney, Agent, or Firm* — Cantor Colburn LLP

(57) ABSTRACT

Provided is a magnetic element capable of enhancing fixing strength of a base with respect to a core even if the base is fixed to the core by insert molding. A magnetic element (1) includes a core (2) made of a magnetic material, and resin bases (3 and 4) formed by insert molding so as to be fixed to end portions of the core (2), in which the core (2) is provided with a recess (2*b*) recessed from an end face (2*a*). In the magnetic element (1), it is possible to enhance the fixing strength of the bases (3 and 4) with respect to the core (2).

14 Claims, 11 Drawing Sheets

FOREIGN PATENT DOCUMENTS

| | | | |
|---|---|---|---|
| JP | 62-9609 | A | 1/1987 |
| JP | 64-16719 | U | 1/1989 |
| JP | 2-150004 | A | 6/1990 |
| JP | H2-79004 | U | 6/1990 |
| JP | 8-167528 | A | 6/1996 |
| JP | 10-303034 | A | 11/1998 |
| JP | 11-8133 | A | 1/1999 |

OTHER PUBLICATIONS

Extended European Search Report for Application No./Patent No. 08777411.3-1248/2172948 dated Jun. 23, 2010.
Notice of Reasons for Rejection of Japanese Patent Application No. 2009-520535, mailed Oct. 9, 2012, with English translation.

* cited by examiner

| SAMPLE No. | STRENGTH AGAINST DETACHMENT [N] | |
|---|---|---|
| | EMBODIMENT | COMPARISON REFERENCE |
| 1 | 14.00 | 6.40 |
| 2 | 12.80 | 6.40 |
| 3 | 14.80 | 9.20 |
| 4 | 13.00 | 7.40 |
| 5 | 12.40 | 4.40 |
| 6 | 15.60 | 4.80 |
| 7 | 12.20 | 6.40 |
| 8 | 13.60 | 7.20 |
| 9 | 15.00 | 7.20 |
| 10 | 12.40 | 7.60 |
| 11 | 14.40 | 9.20 |
| 12 | 12.80 | 7.00 |
| 13 | 12.20 | 7.40 |
| 14 | 12.80 | 6.80 |
| 15 | 13.40 | 8.80 |
| 16 | 12.80 | 7.60 |
| 17 | 12.00 | 5.60 |
| 18 | 13.00 | 6.00 |
| 19 | 13.60 | 6.80 |
| 20 | 13.40 | 6.00 |
| AVERAGE VALUE | 13.31 | 6.91 |
| MAXIMUM VALUE | 15.60 | 9.20 |
| MINIMUM VALUE | 12.00 | 4.40 |

Fig.5

MAGNETIC ELEMENT, AND ANTENNA DEVICE USING THE MAGNETIC ELEMENT

CROSS REFERENCE TO RELATED APPLICATIONS

This is a U.S. national stage of application Ser. No. PCT/JP2008/061251, filed on 19 Jun. 2008. Priority under 35 U.S.C. §119(a) and 35 U.S.C. §365(b) is claimed from Japanese Application No. 2007-160875, filed 19 Jun. 2007, the disclosure of which is also incorporated herein by reference.

1.) Technical Field

The present invention relates to a magnetic element including a core made of a magnetic material and a resin base fixed to the core, and to an antenna device using the magnetic element.

2.) Related Art

Conventionally, there is known an inductance element including a core made of a magnetic material and a resin base fixed to the core (see, for example, Patent Document 1). The inductance element described in Patent Document 1 includes a first core and a second core each made of a magnetic material and resin bases fixed to the first core at both ends thereof. In addition, the bases are fixed to the first core with adhesive.

Patent Document 1: JP H02-150004 A

DISCLOSURE OF THE INVENTION

Problems to be Solved by the Invention

As described above, in the inductance element described in Patent Document 1, the bases are fixed to the core with an adhesive. On the other hand, in order to simplify manufacturing steps therefor, insert molding may be used for fixing the resin base to the core. However, compared with the case where the base is fixed to the core with the adhesive, it is difficult to secure fixing strength of the base with respect to the core in the case where the base is fixed to the core by the insert molding.

Therefore, an object of the present invention is to provide a magnetic element capable of enhancing the fixing strength of the base with respect to the core even if the base is fixed to the core by the insert molding, and to provide an antenna device using the magnetic element.

Means for Solving the Problems

In order to solve the above-mentioned problems, a magnetic element according to the present invention includes a core made of a magnetic material and a resin base that is formed by insert molding so as to be fixed to at least one of end portions of the core, in which the base is provided with a recess or a protrusion formed on an end surface of the one of end portions of the core.

According to the magnetic element of the present invention, a recess is formed in at least one end surface of a core to which a base is fixed, so as to be recessed inward from an end surface. For this reason, when the base is formed by insert molding, a resin is led into the recess. Therefore, the contact area between the base and the core is increased to the extent that the recess is formed so that the contact resistance between the base and the core can be increased. Alternatively, according to the magnetic element of the present invention, a protrusion is formed on at least one end surface of the core. For this reason, when the base is formed by the insert molding, the resin is not formed at an engaging portion with the protrusion of the core. Therefore, the contact area between the base and the core is increased to the extent that the protrusion of the core is formed so that the contact resistance between the base and the core can be increased. As a result, according to the present invention, the fixing strength of the base with respect to the core can be enhanced even if the base is fixed to the core by the insert molding.

In the present invention, it is preferred that an inner surface of the recess or an outer surface of the protrusion be formed so as to be parallel to the center axis of the core. With this configuration, for example, grinding and coding can be performed more easily and quality of the core can be secured more easily than the case of a non-parallel shape with respect to the center axis of the core.

In the present invention, it is preferred that the recess have a circular shape when the end surface of the core is viewed from the axial direction. With this configuration, for example, the recess can be formed more easily compared with the case where a shape of the end surface of the core viewed from the axial direction is a polygonal shape.

In the present invention, it is preferred that the recess have a polygonal shape when the end surface of the core is viewed from the axial direction. With this configuration, for example, a positional shift of the base can be prevented by preventing rotation of the core in the circumferential direction compared with the case where a shape of the end surface of the core viewed from the axial direction is a circular shape.

In the present invention, it is preferred that the protrusion have a circular shape when the end surface of the core is viewed from the axial direction. With this configuration, for example, the protrusion can be formed more easily compared with the case where a shape of the end surface of the core viewed from the axial direction is a polygonal shape.

In the present invention, it is preferred that a shape of the end surface of the core viewed from the axial direction be a polygonal shape. With this configuration, for example, the protrusion can prevent rotation of the core in the circumferential direction and can prevent a positional shift of the base compared with the case where the shape of the end surface of the core viewed from the axial direction is a circular shape.

In the present invention, it is preferred that the center axis of the cross-section of the recess or the protrusion, the cross-section being parallel to the end surface of the core, be shifted from the center axis of the core. With this configuration, a center of rotation radius of the core does not agree with a center of rotation radius of the substantially circular or polygonal recess or protrusion. Therefore, a rotation action of the core itself in the circumferential direction does not correspond to a rotation action of the recess or the protrusion, and hence the fixing strength can be enhanced.

In the present invention, it is preferred that the recess be formed like a groove in a radial direction of the end surface of the core, and the protrusion is formed linearly on the end surface of the core. With this configuration, the contact area between the base and the core can be increased so that the contact resistance between the base and the core can be increased. In addition, rotation of the core in the circumferential direction can be prevented, and hence a positional shift of the base can be prevented. As a result, the fixing strength of the base with respect to the core can be enhanced even if the base is fixed to the core by the insert molding.

In the present invention, it is preferred that the recess has a cross-section of a shape other than a perfect circle, the cross-section being parallel to the end surface of the core. With this configuration, the contact area between the base and the core can be increased, and the contact resistance between the base and the core may be increased. In addition, rotation of the core in the circumferential direction can be prevented, and a positional shift of the base may be prevented.

In the present invention, it is preferred that a length of a part of the recess that is recessed inward from the end surface of the core to which the base is fixed be shorter than a length of the base from an end surface on the a side that is fixed to the core to a part of the recess that contacts with the end surface. With this configuration, a position of the bottom surface of the recess does not correspond to a position of the end surface of the base that is fixed to the core, and hence a decrease in the fixing strength of the core in the circumferential direction can be avoided.

In the present invention, it is preferred that a length from a tip of the protrusion to the end surface of the core be shorter than a length from an end surface of the base on a side that is fixed to the core to apart that comes in contact with the tip of the protrusion. With this configuration, a position of the bottom surface of the protrusion does not correspond to a position of the end surface of the base that is fixed to the core, and hence a decrease in the fixing strength of the core in the circumferential direction can be avoided.

In the present invention, it is preferred that a cross-sectional area of the recess, the cross-sectional area being parallel to the end surface of the core, increase gradually toward a depth direction of the recess. With this configuration, the core becomes resistant to being detached from the base, and hence detachment of the core can be prevented.

In the present invention, it is preferred that a cross-sectional area of the protrusion, the cross-sectional area being parallel to the end surface of the core, increase gradually toward a tip direction of the protrusion. With this configuration, the core becomes resistant to being detached from the base, and hence detachment of the core can be prevented.

In the present invention, it is preferred to provide an antenna device using any one of the above-mentioned magnetic elements.

Effects of the Invention

As described above, according to the magnetic element of the present invention, the fixing strength of the base with respect to the core can be enhanced even if the base is fixed to the core by insert molding.

BRIEF DESCRIPTION OF THE DRAWINGS

FIGS. 3A and 3B illustrate the core illustrated in FIG. 1, in which FIG. 3A illustrates the core viewed from a direction perpendicular to the axial direction while FIG. 3B illustrates the core viewed from the axial direction.

FIG. 5 illustrates experimental data showing an effect of the magnetic element according to Embodiment 1 of the present invention.

FIGS. 6A and 6B illustrate states of one of the end surfaces of the core according to another Embodiments 1 and 2 of the present invention viewed from the axial direction, in which FIG. 6A illustrates a recess having a D-shape while FIG. 6B illustrates a recess having a rectangular shape.

FIGS. 7A and 7B illustrate one of recesses of the core according to another Embodiment 3 of the present invention, in which FIG. 7A illustrates the recess viewed from the axial direction while FIG. 7B illustrates the recess viewed from the a-direction.

FIGS. 8A and 8B illustrate one of recesses of the core according to another Embodiment 4 of the present invention, in which FIG. 8A illustrates the recess viewed from the axial direction while FIG. 8B illustrates the recess viewed from the b-direction.

FIGS. 9A and 9B illustrate one of recesses of the core according to another Embodiment 5 of the present invention, in which FIG. 9A illustrates the recess viewed from the axial direction while FIG. 9B is a perspective view of the recess viewed from the c-direction.

FIGS. 11A and 11B illustrate one of protrusions of the core according to another Embodiment 8 of the present invention, in which FIG. 11A illustrates the protrusion having an outer surface that is parallel to the center axis of the core while FIG. 11B illustrates an example of the protrusion having a cross-sectional area that increases toward the tip.

FIGS. 13A and 13B illustrate one of recesses of the core according to another Embodiment 8 of the present invention, in which FIG. 13A illustrates the recess viewed from the axial direction while FIG. 13B illustrates the recess viewed from the d-direction.

FIGS. 14A and 14B illustrate one of protrusions of the core according to another Embodiment 9 of the present invention, in which FIG. 14A illustrates the protrusion viewed from the axial direction of the core while FIG. 14B illustrates a perspective view of the protrusion viewed from the e-direction.

FIGS. 15A and 15B illustrate one of protrusions of the core according to another Embodiment 10 of the present invention, in which FIG. 15A illustrates the protrusion viewed from the axial direction of the core while FIG. 15B illustrates a perspective view of the protrusion viewed from the f-direction.

FIGS. 16A and 16B illustrate one of protrusions of the core according to another Embodiment 11 of the present invention, in which FIG. 16A illustrates the protrusion viewed from the axial direction of the core while FIG. 16B illustrates the protrusion viewed from the g-direction.

FIGS. 17A and 17B are perspective views of magnetic elements according to another Embodiment 12 of the present invention, in which FIG. 17A illustrates a magnetic element having a base at one end while FIG. 17B illustrates a magnetic element having a base at the other end.

DESCRIPTION OF THE SYMBOLS

1 magnetic element, 2 core, 2*a* end surface, 2*b*,2*d*,2*e*,2*f*,2*g* recess, 2*h*,2*i*,2*j*,2*k*,2*m*,2*n* protrusion, 3,4 base

BEST MODE FOR CARRYING OUT THE INVENTION

Now, embodiments of the present invention are described with reference to the drawings. First, a magnetic element 1 according to Embodiment 1 is described with reference to FIGS. 1 to 5.

(Structure of the Magnetic Element According to Embodiment 1)

Figure 1:
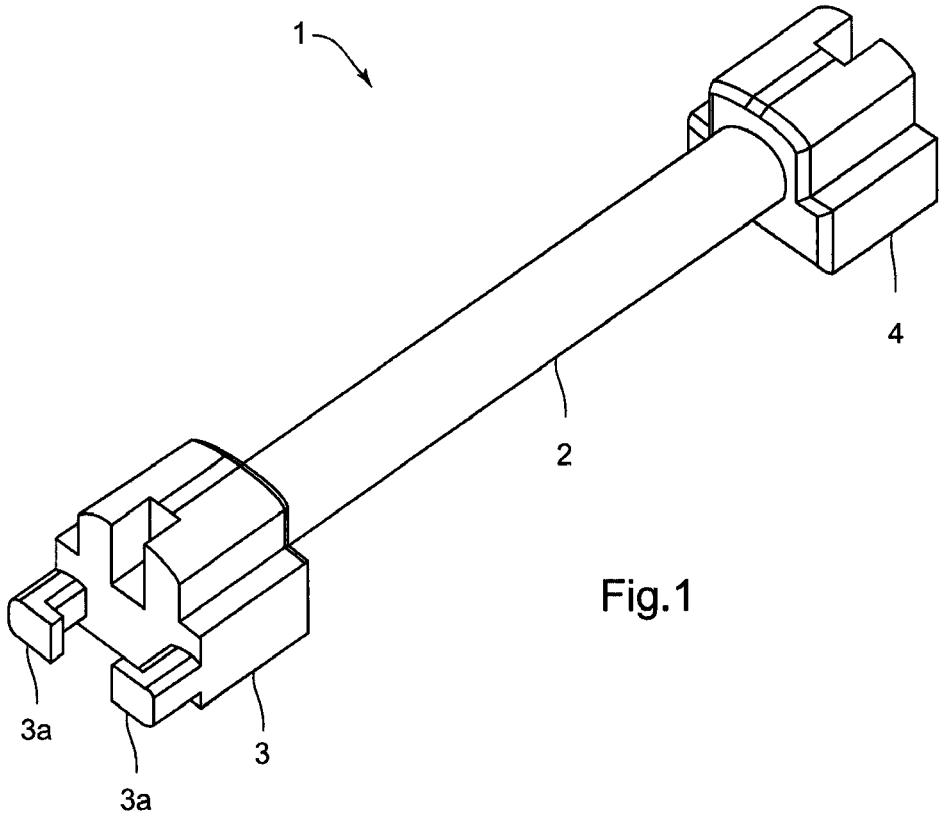
FIG. 1 is a perspective view illustrating a magnetic element according to Embodiment 1 of the present invention.
Figure 2:
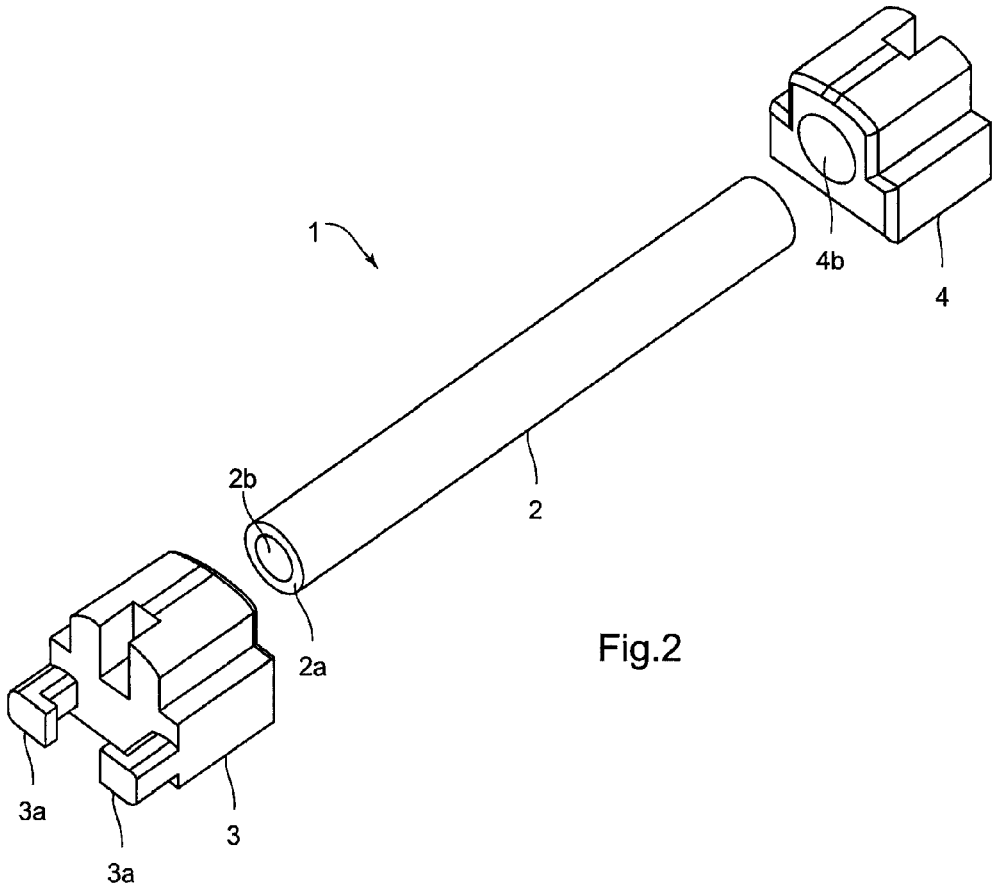
FIG. 2 is an exploded perspective view of the magnetic element illustrated in FIG. 1.
Figure 3A:
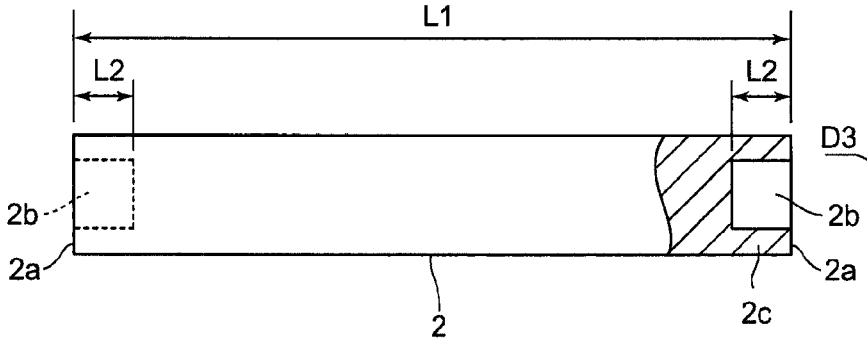
Figure 3B:
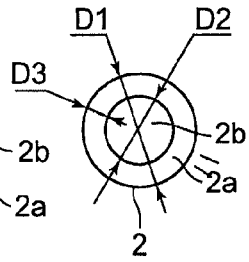
Figure 4:
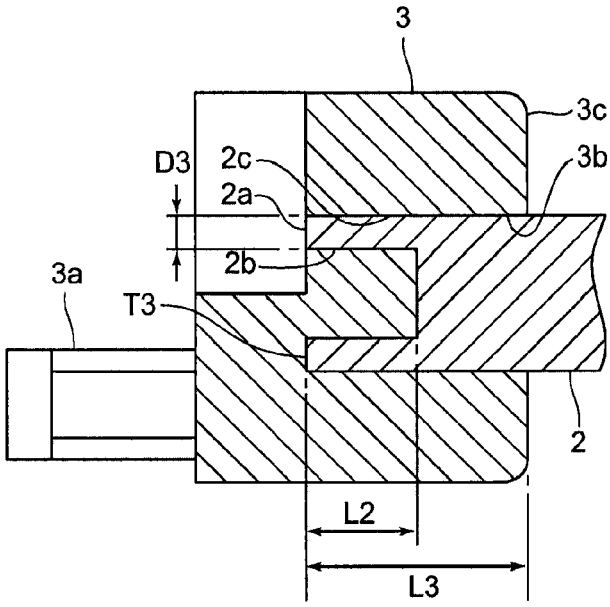
FIG. 4 is a cross-sectional view illustrating a fixing part of one of the bases with respect to the core illustrated in FIG. 1.
Figure 6A:
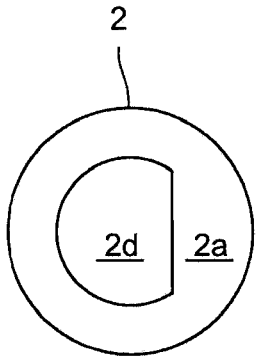
Figure 6B:
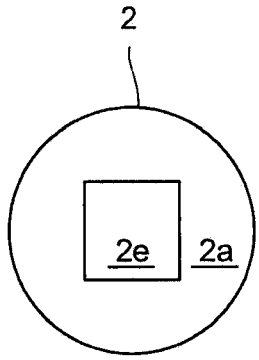
Figure 7A:
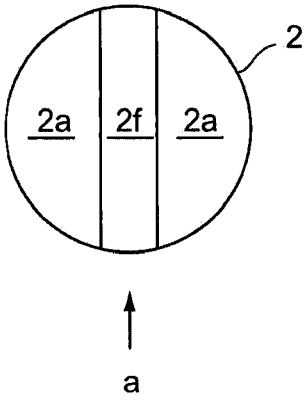
Figure 7B:
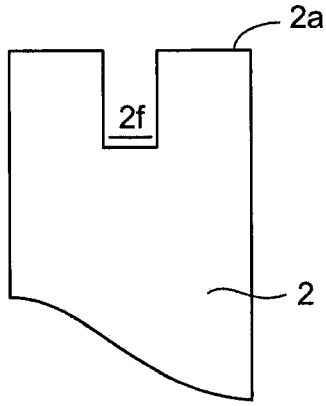

FIG. 1 is a perspective view illustrating the magnetic element 1 according to the embodiment of the present invention. FIG. 2 is an exploded perspective view of the magnetic element 1 illustrated in FIG. 1. FIGS. 3A and 3B are diagrams illustrating a core 2 illustrated in FIG. 1, in which FIG. 3A illustrates the core 2 viewed from a direction perpendicular to an axial direction while FIG. 3B illustrates the core 2 viewed from the axial direction. FIG. 4 is a cross-sectional view of a fixing part of a base 3 with respect to the core 2 illustrated in FIG. 1.

The magnetic element 1 of this embodiment is used for an electronic component or an electronic device such as an antenna device constituting an electronic key system of an automobile or an IC tag. The magnetic element 1 includes the core 2 made of a magnetic material, bases 3 and 4 fixed to end portions of the core 2, and conductor wire (not shown) wound around an outer periphery of the core 2, as illustrated in FIG. 1.

The core 2 is made of a magnetic material as described above. For instance, the core 2 is made of a magnetic material such as Mn—Zn ferrite or Ni—Zn ferrite. The core 2 is formed to have a linear elongated rod-like shape. Specifically, the core 2 is formed to have a cylindrical (or substantially cylindrical) shape. In addition, the core 2 is provided with a recess 2*b* that is recessed inward from an end surface 2*a* as illustrated in FIG. 3. Specifically, the core 2 is provided with the recess 2*b* like a round hole having a bottom formed radially inward of the core 2. In other words, a cross-section parallel to the end surface 2*a* of the recess 2*b* (cross-section perpendicular to the axial direction of the core 2) is formed to have a circular shape (or substantially circular shape) having a constant diameter. In other words, the recess 2*b* is formed to have a circular shape (or substantially circular shape) when viewed from the axial direction. In addition, the recess 2*b* is formed in the end surface 2*a* of each end portion of the core 2.

The bases 3 and 4 are made of non-magnetic and insulative resin and are formed to have a block shape. In this embodiment, the base 3 is fixed to one end portion of the core 2 and the base 4 is fixed to the other end portion of the core 2. Specifically, the bases 3 and 4 are fixed to the end portions of the core 2 so that mounting surfaces with respect to a mounting substrate or the like to which the magnetic element 1 is mounted become parallel to each other (surface corresponding to the backside of the paper of FIG. 1, or lower side of FIG. 4). In addition, the bases 3 and 4 are fixed to the end portions of the core 2 so that the bases 3 and 4 cover the end surfaces 2*a* and the outer peripheral surfaces of the core 2 at the end portions.

The base 3 arranged at one end is provided with two terminal portions 3*a* to which end portions of the conductor wire wound around the core 2 are fixed by being wound around the same. The terminal portions 3*a* are formed so as to protrude outward in the axial direction of the core 2. Note that the base 4 is formed similarly to the base 3 except for provision of the terminal portions 3*a*.

In this embodiment, as described later, the bases 3 and 4 are formed integrally with the core 2 by insert molding. For this purpose, the bases 3 and 4 are provided with arrangement holes 3*b* and 4*b* to which the end portions of the core 2 are arranged. In addition, a resin that forms the bases 3 and 4 is led and filled in the recess 2*b* as illustrated in FIG. 4. Note that in this embodiment the bases 3 and 4 are formed integrally with the core 2 by insert molding so that flatness of the mounting surfaces of the bases 3 and 4 can be enhanced.

The conductor wire (not shown) wound around the outer periphery of the core 2 is obtained by covering the surface of the conductive wire material with an insulating coating. Each of the end portions of the conductor wire is wound around the terminal portion 3*a* of the base 3 so as to be fixed. Specifically, the end portion of the wound conductor wire is soldered so that each of the end portions of the conductor wire is fixed to the terminal portion 3*a*.

(Manufacturing Method of the Magnetic Element According to Embodiment 1)

The magnetic element 1 having the structure described above is manufactured as follows.

First, an original body of the core 2 is formed from powder of magnetic material such as ferrite by a press using a molding die. In other words, the original body of the core 2 is formed by powder press molding. After that, the original body of the core 2 is subjected to cutting so that the core 2 is formed. Specifically, the end surfaces 2*a* of both end portions are formed, and the recesses 2*b* are formed so as to be recessed inward from the end surfaces 2*a*, by cutting. The core 2 is completed by this cutting.

After that, the bases 3 and 4 are formed integrally with the core 2 by the insert molding in which the both end portions of the core 2 are arranged in the die for performing resin molding. In other words, the both end portions of the core 2 are placed in the die, resin is filled in the die, and the resin in the die is stiffened. The bases 3 and 4 illustrated in FIG. 2 and the like are formed by this insert molding. In addition, during this insert molding method, the resin that forms the bases 3 and 4 is filled in the recesses 2*b* of the core 2.

After that, one end of the conductor wire is wound around one terminal portion 3*a* and is bound. In this state, the conductor wire is wound around the outer periphery of the core 2. After the conductor wire is wound a predetermined number of times, the other end portion of the conductor wire is wound around the other terminal portion 3*a* and is bound. After that, the end portions of the conductor wire wound around the terminal portions 3*a* are soldered so that the magnetic element 1 is completed.

(Main Effect of the Magnetic Element According to Embodiment 1)

As described above, according to the magnetic element 1 of Embodiment 1, the core 2 is provided with the recesses 2*b* that are formed to be recessed inward from the end surface 2*a*. Therefore, when the bases 3 and 4 are formed by the insert molding, the resin is led and filled in the recess 2*b*. Therefore, in addition to the end surfaces 2*a* of the core 2 and the outer peripheral surfaces at the end portions of the core 2, the inner walls of the recesses 2*b* contact with the resin that forms the bases 3 and 4. In other words, the contact area between each of the bases 3,4 and the core 2 can be increased, and hence the contact resistance between each of the bases 3,4 and the core 2 can be increased. As a result, in this embodiment, even if the bases 3 and 4 are fixed to the core 2 by the insert molding, the fixing strength of the bases 3 and 4 with respect to the core 2 can be enhanced.

The effect of this embodiment is described more concretely based on experimental data. FIG. 5 illustrates experimental data showing the effect of the magnetic element 1 according to the embodiment of the present invention.

As the experiment, there was measured the fixing strength of the bases 3 and 4 with respect to the core 2 in the axial direction of the core 2 (i.e., strength against detachment) when a total length L1 of the core 2 illustrated in FIG. 3 is 8.8 mm, an outer diameter D1 of the core 2 is 0.9 mm, a depth L2 from the end surface 2*a* to the bottom of the recess 2*b* is 0.5 mm, and an inner diameter D2 of the recess 2*b* is 0.5 mm. In this measurement, twenty samples were used. The results are shown in the column of "EMBODIMENT" in FIG. 5. In addition, for comparison, a core which has the same total length L1 and the same outer diameter D1 as the core 2 and is not provided with the recess 2*b* (this core is referred to as "core 52" for convenience sake) was measured regarding the strength against detachment of the bases 3 and 4 (fixing strength of the core 52 in the axial direction). In this measurement too, twenty samples were used. The results are shown in the column of "COMPARISON REFERENCE" in FIG. 5. Note that material of the cores 2 and 52 used in this experiment is manganese ferrite, and material of the bases 3 and 4 is liquid crystal polymer.

As illustrated in FIG. 5, an average value of the strength against detachment of the bases 3 and 4 with respect to the core 2 was 13.31 N (Newton), a maximum value of the same was 15.6 N, and a minimum value of the same was 12 N. In contrast, the average value of the strength against detachment of the bases 3 and 4 with respect to the core 52 was 6.91N, the maximum value was 9.2N, and the minimum value was 4.4 N. In this way, the strength against detachment of the bases 3 and 4 with respect to the core 2 was much higher than the strength against detachment of the bases 3 and 4 with respect to the core 52. For instance, the average value of the strength against detachment of the bases 3 and 4 with respect to the core 2 was 1.9 times the average value of the strength against detachment of the bases 3 and 4 with respect to the core 52.

In this way, according to this embodiment, the strength against detachment of the bases 3 and 4 with respect to the core 2 can be increased substantially. In addition, the contact area between each of the bases 3,4 and the core 2 can be increased, and hence the fixing strength of the bases 3 and 4 with respect to the core 2 in the circumferential direction of the core 2 can also be increased. As a result, according to this embodiment, the fixing strength of the bases 3 and 4 with respect to the core 2 can be increased even if the bases 3 and 4 are fixed to the core 2 by the insert molding.

Note that it is obvious from the results of the experiment described above that, if the structure of this embodiment is adopted in the case where the outer diameter of the core 2 is relatively small like 0.9 mm, an outstanding effect can be obtained. In other words, the structure of this embodiment is more suitable for a small magnetic element 1.

According to this embodiment, the recesses 2*b* are formed to have a circular shape when viewed from the axial direction. Therefore, for example, compared with the case where the recesses 2*b* are formed to have a polygonal shape viewed from the axial direction, the core 2 can be formed accurately, and the recesses 2*b* can be formed easily. In other words, if the recesses 2*b* are formed to have a polygonal shape when viewed from the axial direction, it is necessary to form the recesses 2*b* by the powder press molding, and hence it is difficult to increase accuracy of the core 2 in the longitudinal direction because the core 2 is formed only by the powder press molding. In addition, if the diameter of the core 2 is decreased, it is difficult to form the recess 2*b* by the die because of a strength problem of the die. In contrast, if the recess 2*b* is formed to have a circular shape when viewed from the axial direction, accuracy of the core 2 in the longitudinal direction can be increased by the cutting after the powder press molding, and the recess 2*b* can be formed easily.

According to this embodiment, the core 2 is formed to have a cylindrical shape. For this reason, compared with the case where the core 2 is formed to have a polygonal column shape, warping of the core 2 after the powder press molding can be suppressed so that the core 2 can be formed accurately. In addition, according to this embodiment, even if the core 2 is formed to have a cylindrical shape, the fixing strength of the bases 3 and 4 with respect to the core 2 in the circumferential direction of the core 2 can be increased as described above. Therefore, even in this case, it is not necessary to provide an additional structure for stopping rotation of the bases 3 and 4 with respect to the core 2 so that the structure of the magnetic element 1 can be simplified. In addition, according to this embodiment, the inner surfaces of the recesses 2*b* are formed in parallel to the center axis of the core 2 in the axial direction. This facilitates grinding and coding of the core 2 after the powder press molding so that constant quality can be secured easily, compared with the case where the inner surfaces of the recesses 2*b* are formed not in parallel to the center axis of the core 2 but in a manner of crossing the same so as to form an inclined surface.

According to this embodiment, as illustrated in FIG. 4, the length (L2) of the portion recessed inward from the end surface 2*a* of the core 2 is shorter than the length (L3) from the end surface 3*c* of the base 3 facing the core 2 to the end surface 2*a*. This is for the purpose of avoiding a decrease in the fixing strength of the core 2 when a stress is exerted on the core 2 in the case where a position of the bottom surface of the recess 2*b* corresponds to a position of the end surface 3*c* of the base 3 on the side to be fixed to the core 2 (in the case where the lengths L2 and L3 correspond to each other) and in the case where L2 is longer than L3.

(Other Embodiments)

In the embodiment described above, the end surfaces 2*a* of the both end portions are formed and the recesses 2*b* that are recessed inward from the end surfaces 2*a* are also formed by the cutting after the powder press molding. Alternatively, for example, the recesses 2*b* that are recessed inward from the end surfaces 2*a* may be formed in the original body of the core 2 by the powder press molding. Even in this case, the recesses 2*b* are formed to have a circular shape when viewed from the axial direction, and hence the die for the powder press molding can be simplified compared with the case where the recesses 2*b* are formed to have a polygonal shape when viewed from the axial direction. Therefore, even if the diameter of the core 2 is decreased, strength of the die can be increased so that the recesses 2*b* can be formed easily by the die. Further, in this case, strength of the core 2 itself can also be improved. Note that one end portion of the original body of the core 2 should be polished in this case so that accuracy of the core 2 in the longitudinal direction can be secured.

According to Embodiment 1 described above, the recesses 2*b* are formed so as to have a circular shape when the end surfaces 2*a* are viewed from the axial direction. Alternatively, for example, recesses 2*d* having a D-shape as a shape other than a perfect circle when the end surfaces 2*a* are viewed from the axial direction may be formed in the end surfaces 2*a* of the core 2 like another Embodiment 2 illustrated in FIG. 6(A). Alternatively, recesses 2*e* having a rectangular shape when viewed from the axial direction may be formed in the end surfaces 2*a* of the core 2 like another Embodiment 2 illustrated in FIG. 6(B). Alternatively, recesses having a polygonal shape (such as a triangular shape and a pentagonal shape) other than the rectangular shape or an elliptic shape when the end surfaces 2*a* are viewed from the axial direction may be formed in the core 2. Alternatively, recesses 2*f* having a linear and grooved shape may be formed in the end surfaces 2*a* of the core 2 like another Embodiment 3 illustrated in FIGS. 7A and 7B. If the structures illustrated in FIGS. 6A and 6B and 7A and 7B are adapted, the contact resistance between each of the bases 3,4 and the core 2 can be increased. In addition, rotation of the core 2 illustrated in FIGS. 6 A and 6B and 7 A and 7B in the circumferential direction can be prevented, and hence the positional shift of the bases 3 and 4 can be prevented. As a result, according to the structures illustrated in FIGS. 6 A and 6B and 7 A and 7B, the fixing strength of the bases 3 and 4 with respect to the core 2 in the circumferential direction can be enhanced even if the bases 3 and 4 are fixed to the core 2 by the insert molding.

Figure 8A:
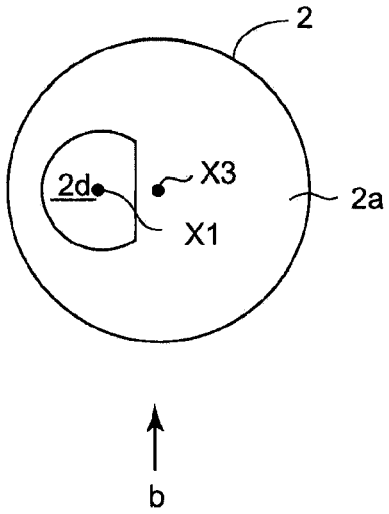
Figure 8B:
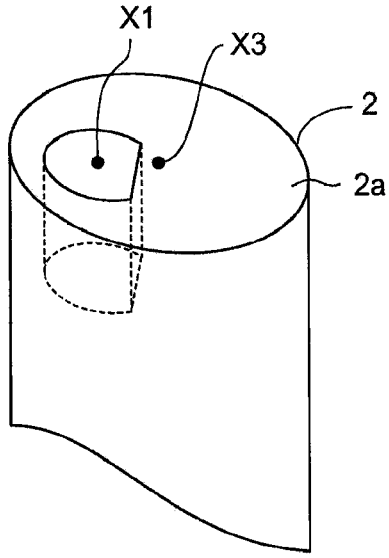
Figure 9A:
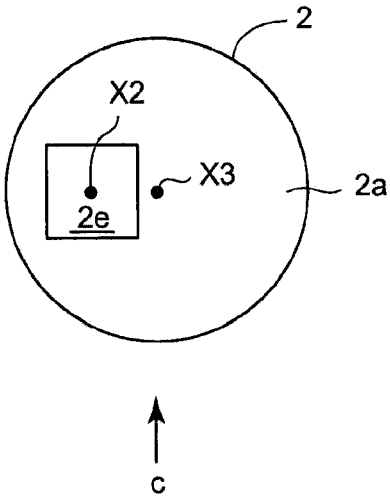
Figure 9B:
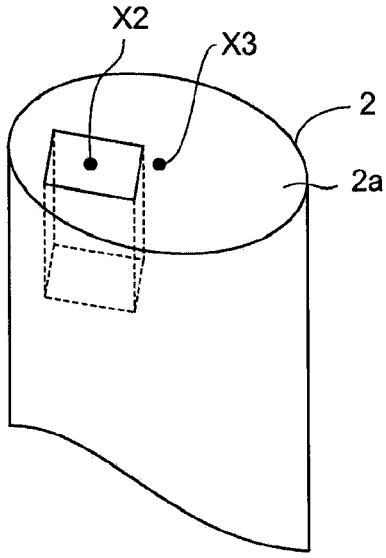

In addition, like another Embodiment 4 illustrated in FIG. 8 and another Embodiment 5 illustrated in FIGS. 9A and 9B, the center axis X1 or X2 of the recesses 2*d* or 2*e* described above may be formed in the core 2 so as to be shifted from the center axis X3 of the core 2. In this case, the fixing strength of the core 2 with respect to the bases 3 and 4 in the circumferential direction can be increased largely, and hence rotation restriction of the core 2 with respect to the bases 3 and 4 can be secured.

Further, in the embodiments described above, the recesses 2*d*, 2*e* and 2*f* have a shape with the inner surface or the outer surface that is parallel to the axial direction. Alternatively, for example, like the end surfaces 2*a* of another Embodiment 6 illustrated in FIG. 10, there may be formed recesses 2*g* having an tapered cylinder shape in which the inner surface 2*g*1 is not parallel to the center axis X3 of the core 2 but crosses the same so as to have an inclined surface, and the cross-sectional area increases gradually toward the depth direction of the core 2. Note that the recesses 2*g* formed in the tapered cylinder shape may be modified to have a tapered polygonal column shape.

Figure 11A:
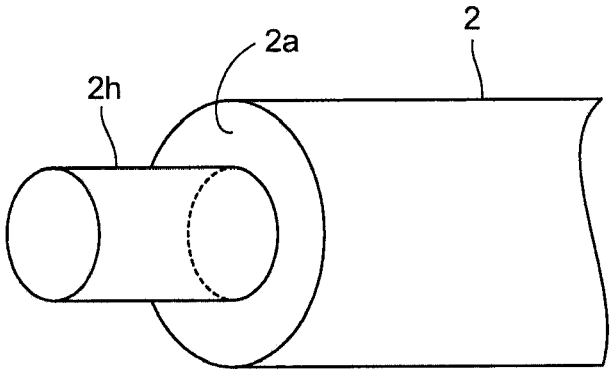

In Embodiment 1 described above, the core 2 is provided with the recesses 2*b* that are formed to be recessed from the end surfaces 2*a* inward in the radial direction of the core 2. Alternatively, for example, as illustrated in FIG. 11(A), protrusions 2*h* may be formed on the end surfaces 2*a* of the core 2 so that only the tips of the core 2 are protruded. In this case, as illustrated in FIG. 11(A), it is preferable that the outer surfaces of the protrusions 2*h* should be formed to be parallel to the center axis of the core 2. In addition, like another Embodiment 8 illustrated in FIG. 11 (B), the cross-sectional area of the protrusion 2*i* that is parallel to the end surface 2*a* of the core 2 may be formed to increase gradually toward the tip of the protrusion 2*i*. If the structure illustrated in FIG. 11 (B) is adopted, the core 2 is hardly detached from the bases 3 and 4. Thus, detachment of the core can be prevented.

Figure 12:
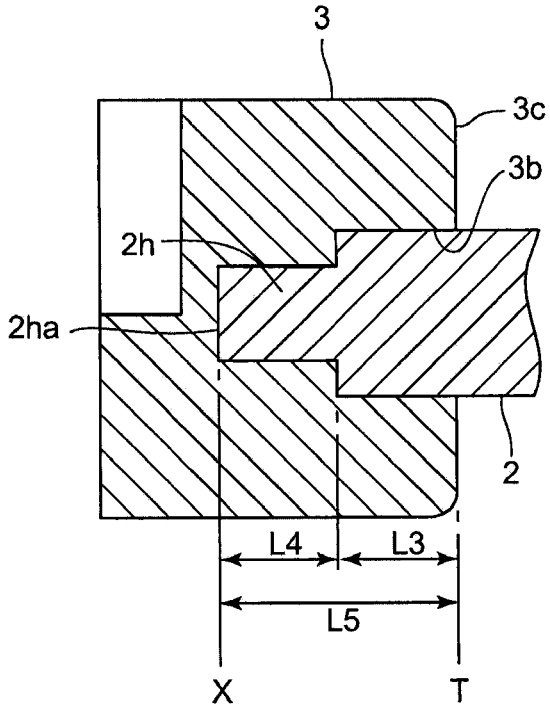
FIG. 12 is a cross-section of the fixing part of one of the bases with respect to the core according to another Embodiment 7 of the present invention.

In addition, as illustrated in FIG. 12, it is preferable that a length (L4) of the protrusion 2*h* from the tip 2*ha* of the protruding portion to the end surface 2*a* should be shorter than a length (L5) of the base 3 from the end surface 3*c* facing the core 2 to the protrusion 2*h*. This is for the purpose of avoiding a decrease in the fixing strength of the core 2 when a stress is exerted on the core 2 in the case where a position of the bottom surface of the protrusion 2*h* corresponds to a position of the end surface 3*c* of the base 3 on the side to be fixed to the core 2 (in the case where the lengths L4 and L5 correspond to each other) and in the case where L4 is longer than L5.

Figure 13A:
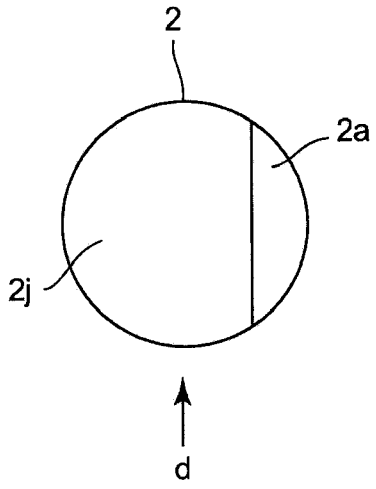
Figure 13B:
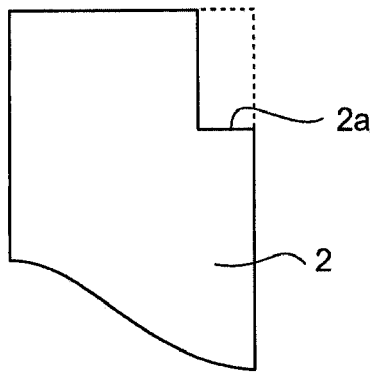

In addition, like another Embodiment 8 illustrated in FIG. 13 (A), only a part of the end surface 2*a* is cut out when the core 2 is viewed from the axial direction so that the remaining protruding part becomes the protrusion 2*j*.

Figure 14A:
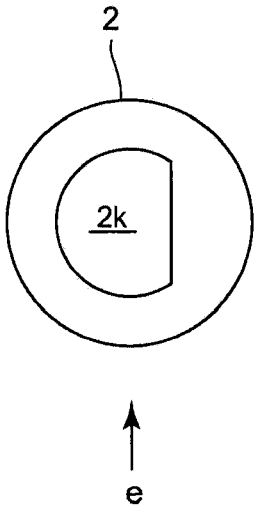
Figure 14B:
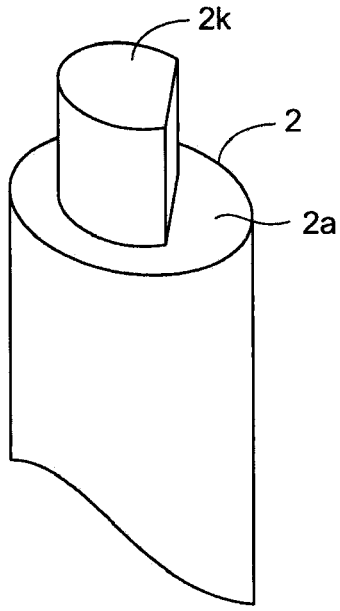
Figure 15A:
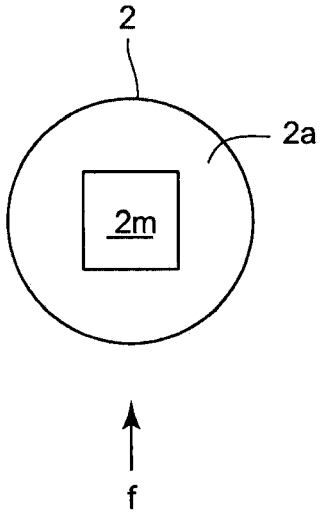
Figure 15B:
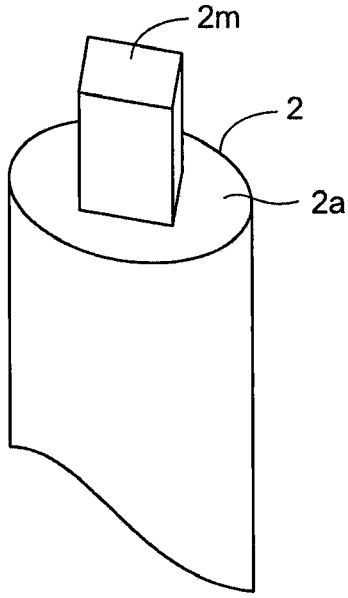

In addition, like another Embodiment 9 illustrated in FIGS. 14A and 14B or another Embodiment 10 illustrated in FIGS. 15A and 15B, D-shape protrusions 2*k* or rectangular shape protrusions 2*m* may be adopted similarly to the recesses 2*d* or 2*e* described above. The center axes of the protrusions 2*k* and 2*m* are the same as the center axis X3 of the core 2. Note that the center axis X3 of the protrusions 2*j*, 2*k* or 2*m* may be shifted from the center axis of the core 2 (not shown). Even in this case, the contact area between each of the bases 3 and 4 and the core 2 can be increased so that the fixing strength of the bases 3 and 4 with respect to the core 2 can be enhanced.

Figure 16A:
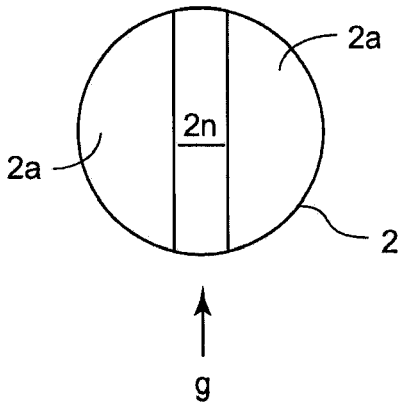
Figure 16B:
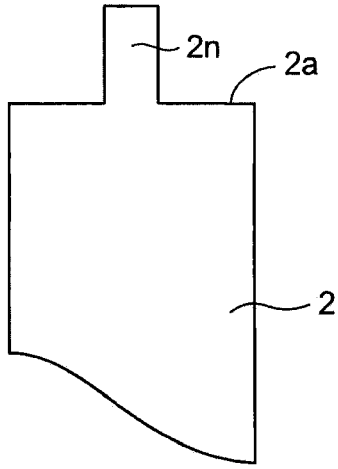

In addition, like another Embodiment 11 illustrated in FIG. 16(A), protrusions 2*n* may be formed so as to cross the core 2 sectionally or longitudinally with respect to the radial direction viewed from the axial direction. When the protrusion 2*n* is viewed from the g-direction as illustrated in FIG. 16(B), the protrusion 2*n* is formed from one end of the outer periphery to the other end of the outer periphery. Even in this structure, the contact area between each of the bases 3,4 and core 2 can be increased so that the fixing strength of the bases 3 and 4 with respect to the core 2 can be enhanced.

In each embodiment described above, the core 2 is formed to have a cylindrical shape. Alternatively, for example, the core 2 may be formed to have a polygonal column shape such as a rectangular column shape or a pentagonal column shape. Alternatively, the core 2 may be formed to have an elliptic cylinder shape. Further, in each embodiment described above, the center axis X3 of the core 2 and the center axis of the recess or the protrusion are the same or parallel to each other, but the center axes may be neither the same nor parallel to each other.

Figure 17A:
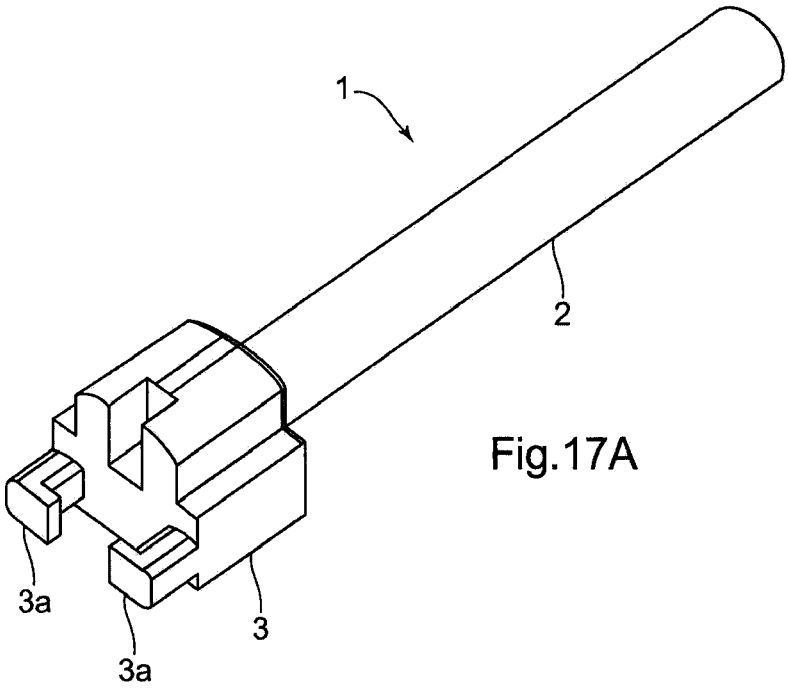
Figure 17B:
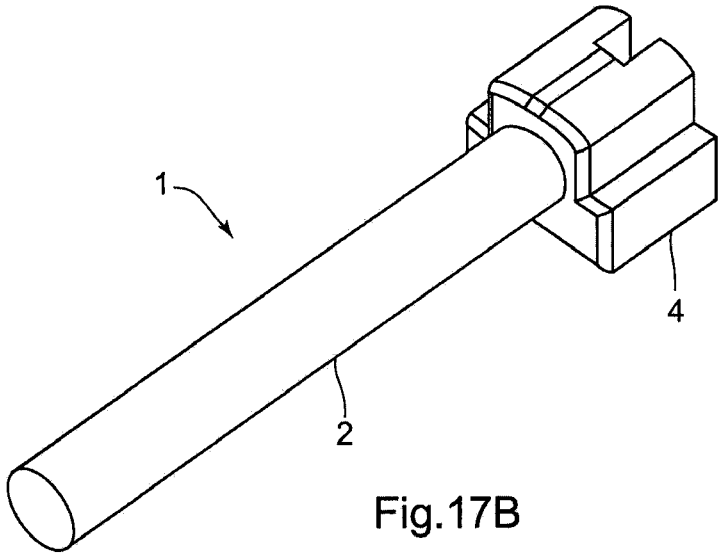

In each embodiment described above, the bases 3 and 4 are fixed to both ends of the core 2. Alternatively, for example, like another Embodiment 12 illustrated in FIG. 17(A) or 17(B), the base 3 or 4 may be fixed to only one end or to the other end of the core 2. In this case, the recess 2*b* may be formed only in the end surface 2*a* on the side to which the base 3 or 4 is fixed, or the recess 2*b* may be formed in each end surface 2*a* of both sides of the core 2. Further, in the above-mentioned embodiments, the example having one core 2 and two bases 3,4, as well as the example having one core 2 and one base 3 or having one core 2 and one base 4 is described, but it is possible to adopt the magnetic element including two cores 2 and one base 3, the magnetic element including two cores 2 and two bases 3,4, or the magnetic element including one core 2 and three bases.

Figure 10:
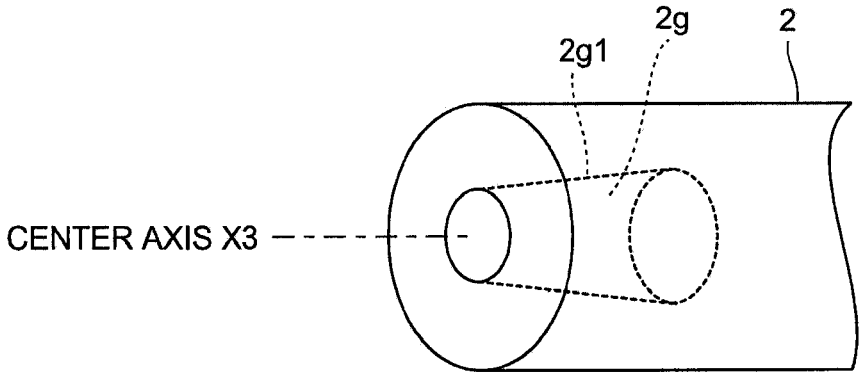
FIG. 10 is a diagram illustrating a core according to another Embodiment 6 of the present invention.
Figure 11B:
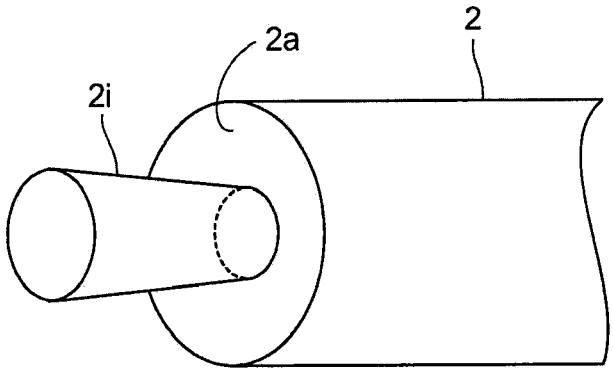

In each embodiment described above, the base 3 is provided with the two terminal portions 3*a*, but it is possible that each of the bases 3 and 4 is provided with one terminal portion. In addition, it is possible that a metal terminal is formed integrally with the base 3 and/or base 4. Further, the magnetic element described above includes the conductor wire, but the magnetic element may be one in the state without the conductor wire. In addition, a contour line of the inner surface constituting the recess such as the recess 2*b* or a contour line of the outer surface constituting the protrusion such as the protrusion 2*h* are formed to be parallel or substantially parallel to the center axis X3 of the core 2. In this application, however, the term "parallel" is used so as to include the case where they are substantially parallel as illustrated in FIGS. 10 and 11(B) (case where the inclination with respect to the center axis X3 is 10 degrees or smaller). Note that these contour lines may not be parallel.

The invention claimed is:

1. A magnetic element comprising:

a core made of a magnetic material; and a base made of resin that is integrally formed with an end surface of the core without using an adhesive by insert molding involving filling an insert molding die with a molten resin and stiffening the resin under a state in which at least one end portion of the core is arranged in the insert molding die;

wherein the core comprises a recess or a protrusion provided on an end surface of the end portion;

an inner surface of the recess or an outer surface of the protrusion is formed so as to be parallel to a center axis of the core;

a length of a part of the recess that is recessed inward from the end surface of the core to which the base is fixed is formed to be shorter than a length of the base from an end surface on a side that is fixed to the core to a part of the recess that contacts with the end surface; and a length from a tip of the protrusion to the end surface of the core is formed to be shorter than a length from an end surface of the base on a side that is fixed to the core to a part that comes in contact with the tip of the protrusion.

2. A magnetic element according to claim 1, wherein the core comprises a recess provided on an end surface of the end portion; and the recess has a circular shape when the end surface of the core is viewed from the axial direction.

3. A magnetic element according to claim 1, wherein the core comprises a recess provided on an end surface of the end portion; and the recess has a polygonal shape when the end surface of the core is viewed from the axial direction.

4. A magnetic element according to claim 1, wherein the core comprises a protrusion provided on an end surface of the end portion; and the protrusion has a circular shape when the end surface of the core is viewed from the axial direction.

5. A magnetic element according to claim 1, wherein the core comprises a protrusion provided on an end surface of the end portion; and the protrusion has a polygonal shape when the end surface of the core is viewed from the axial direction.

6. A magnetic element according to claim 1, wherein the center axis of the cross-section of the recess or the protrusion, the cross-section being parallel to the end surface of the core, is formed so as to shift from the center axis of the core.

7. A magnetic element according to claim 1, wherein the core comprises a recess provided on an end surface of the end portion; and the recess is formed like a groove in a radial direction of the end surface of the core.

8. A magnetic element according to claim 1, wherein the recess is formed so that the cross-section being parallel to the end surface of the core is a shape other than a circle.

9. A magnetic element according to claim 1, wherein a cross-sectional area of the recess being parallel to the end surface of the core is formed to increases gradually toward a depth direction of the recess.

10. A magnetic element according to claim 1, wherein a cross-sectional area of the protrusion being parallel to the end surface of the core is formed increases gradually toward a tip direction of the protrusion.

11. A magnetic element according to claim 1, wherein the core comprises a protrusion provided on an end surface of the end portion; and the protrusion is formed linearly on the end surface of the core.

12. An antenna device comprising:

a magnetic element comprising:

a core made of a magnetic material; and a base made of resin that is integrally formed with an end surface of the core without using an adhesive by insert molding involving filling an insert molding die with a molten resin and stiffening the resin under a state in which at least one end portion of the core is arranged in the insert molding die;

wherein the core comprises a recess or a protrusion provided on an end surface of the end portion;

an inner surface of the recess or an outer surface of the protrusion is formed so as to be parallel to a center axis of the core;

a length of a part of the recess that is recessed inward from the end surface of the core to which the base is fixed is formed to be shorter than a length of the base from an end surface on a side that is fixed to the core to a part of the recess that contacts with the end surface; and a length from a tip of the protrusion to the end surface of the core is formed to be shorter than a length from an end surface of the base on a side that is fixed to the core to a part that comes in contact with the tip of the protrusion.

13. A magnetic element comprising:

a core made of a magnetic material; and a base made of resin;

wherein the base is integrally formed with an end surface of the core without using an adhesive;

the core comprises a recess provided on the end surface of an end portion;

the recess is filled with a resin that forms the base, and in addition to the end surface of the core and an outer peripheral surface at the end portion of the core, an inner wall of the recess comes in contact with the resin that forms the base; and a length of a part of the recess that is recessed inward from the end surface of the core to which the base is fixed is formed to be shorter than a length of the base from an end surface on a side that is fixed to the core to a part of the recess that contacts with the end surface.

14. A magnetic element according to claim 13, wherein the base is integrally formed with an end surface of the core by insert molding involving filling an insert molding die with a molten resin and stiffening the resin under a state in which at least one end portion of the core is arranged in the insert molding die.

* * * * *